US011253989B1

(12) United States Patent
Bock

(10) Patent No.: US 11,253,989 B1
(45) Date of Patent: Feb. 22, 2022

(54) FENCE POST MARKING ASSEMBLY

(71) Applicant: David Bock, Lisle, IL (US)

(72) Inventor: David Bock, Lisle, IL (US)

( * ) Notice: Subject to any disclaimer, the term of this patent is extended or adjusted under 35 U.S.C. 154(b) by 0 days.

(21) Appl. No.: 16/997,358

(22) Filed: Aug. 19, 2020

(51) Int. Cl.
*B25H 7/04* (2006.01)
*E04H 17/26* (2006.01)

(52) U.S. Cl.
CPC ..... *B25H 7/04* (2013.01); *E04H 17/26* (2013.01)

(58) Field of Classification Search
CPC ..... B25H 7/04; E04H 17/26
USPC ..... 33/669
See application file for complete search history.

(56) References Cited

U.S. PATENT DOCUMENTS

| | | | | |
|---|---|---|---|---|
| 4,311,300 | A | 1/1982 | Buerger | |
| 5,961,242 | A * | 10/1999 | Leone | E04H 17/1417 403/234 |
| 6,178,651 | B1 * | 1/2001 | Yancey | E04G 21/1833 248/156 |
| 6,658,753 | B2 * | 12/2003 | Tatarnic | G01C 9/28 33/613 |
| 7,467,471 | B1 * | 12/2008 | Sutter | B43L 9/04 33/194 |
| 7,726,037 | B1 * | 6/2010 | Jordan | E04H 17/20 33/613 |
| 7,946,052 | B2 * | 5/2011 | Stevens | E04G 17/14 33/645 |
| D748,505 | S | 2/2016 | Watson | |
| 9,297,180 | B1 | 3/2016 | Tumamao | |
| 9,334,673 | B2 * | 5/2016 | Knudsen | E04H 12/2284 |
| 10,655,359 | B2 * | 5/2020 | Hemingway | E04H 17/263 |
| 11,015,367 | B2 * | 5/2021 | Knudsen | G01C 5/00 |
| 2006/0185179 | A1 * | 8/2006 | St.Cyr | A63C 19/08 33/41.4 |
| 2009/0165201 | A1 * | 7/2009 | Vultaggio | E04H 4/0062 4/506 |
| 2016/0107478 | A1 * | 4/2016 | Jackson | B44D 3/38 33/414 |
| 2019/0177999 | A1 * | 6/2019 | Hemingway | E04H 17/263 |
| 2021/0278207 | A1 * | 9/2021 | Knudsen | G01C 9/02 |

* cited by examiner

*Primary Examiner* — Yaritza Guadalupe-McCall

(57) ABSTRACT

A fence post marking assembly for marking fence post locations includes a pair of pipes that is each positionable in an upright orientation on ground. In this way each of the pipes can mark the proposed location of a fence post. A pair of supports is each coupled to a respective one of the pipes. A rod is positionable in each of the supports thereby facilitating the pipes to be spaced a pre-determined distance apart from each other. In this way the rod can precisely space the proposed locations for fence posts apart from each other. A can of spray paint is provided to mark the proposed location of the fence posts.

9 Claims, 7 Drawing Sheets

FENCE POST MARKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to marking devices and more particularly pertains to a new marking device for marking proposed fence post locations.

(2) Description of Related Art Including Information Disclosed Under 37 CFR 1.97 and 1.98

The prior art relates to marking devices including a bracing device for holding fence posts in a preferred orientation during installation. The prior art discloses a fence post bracket device that includes a pair of square brackets that insertably receive a fence post and a rod extending between the square brackets. The prior art discloses a fence post centering device that includes a member which has forks on each end for engaging a fence post. The prior art discloses a column spacing device for spacing columns a preferred distance apart from each other. The prior art discloses a jig for constructing a privacy fence that includes reference edges for cutting guides into fence panels.

BRIEF SUMMARY OF THE INVENTION

An embodiment of the disclosure meets the needs presented above by generally comprising a pair of pipes that is each positionable in an upright orientation on ground. In this way each of the pipes can mark the proposed location of a fence post. A pair of supports is each coupled to a respective one of the pipes. A rod is positionable in each of the supports thereby facilitating the pipes to be spaced a pre-determined distance apart from each other. In this way the rod can precisely space the proposed locations for fence posts apart from each other. A can of spray paint is provided to mark the proposed location of the fence posts. The prior art also discloses a post installation device that includes a pair of sleeves for receiving a post and a member that spaces the sleeves apart from each other.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
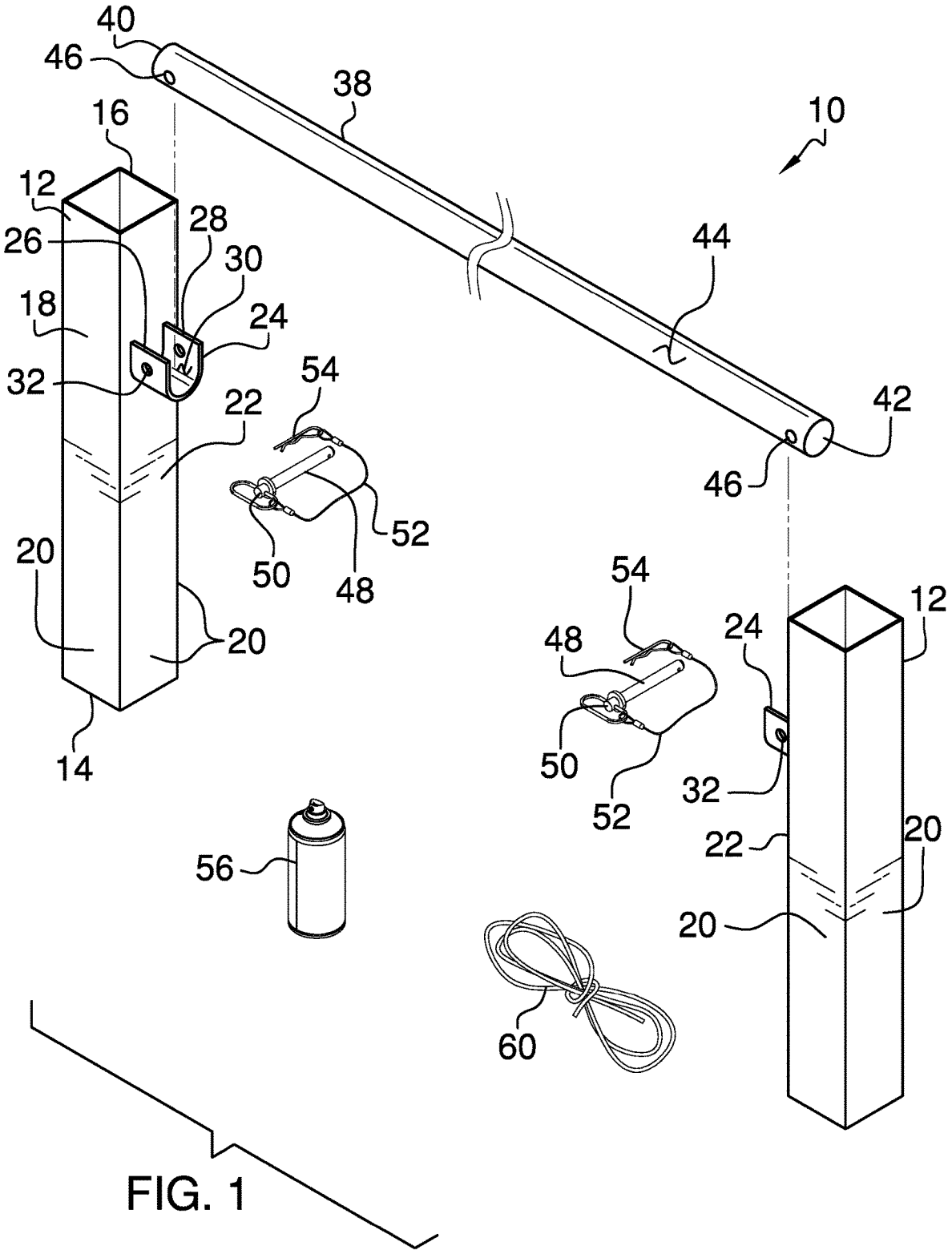
FIG. 1 is a perspective view of a fence post marking assembly according to an embodiment of the disclosure.
Figure 2:
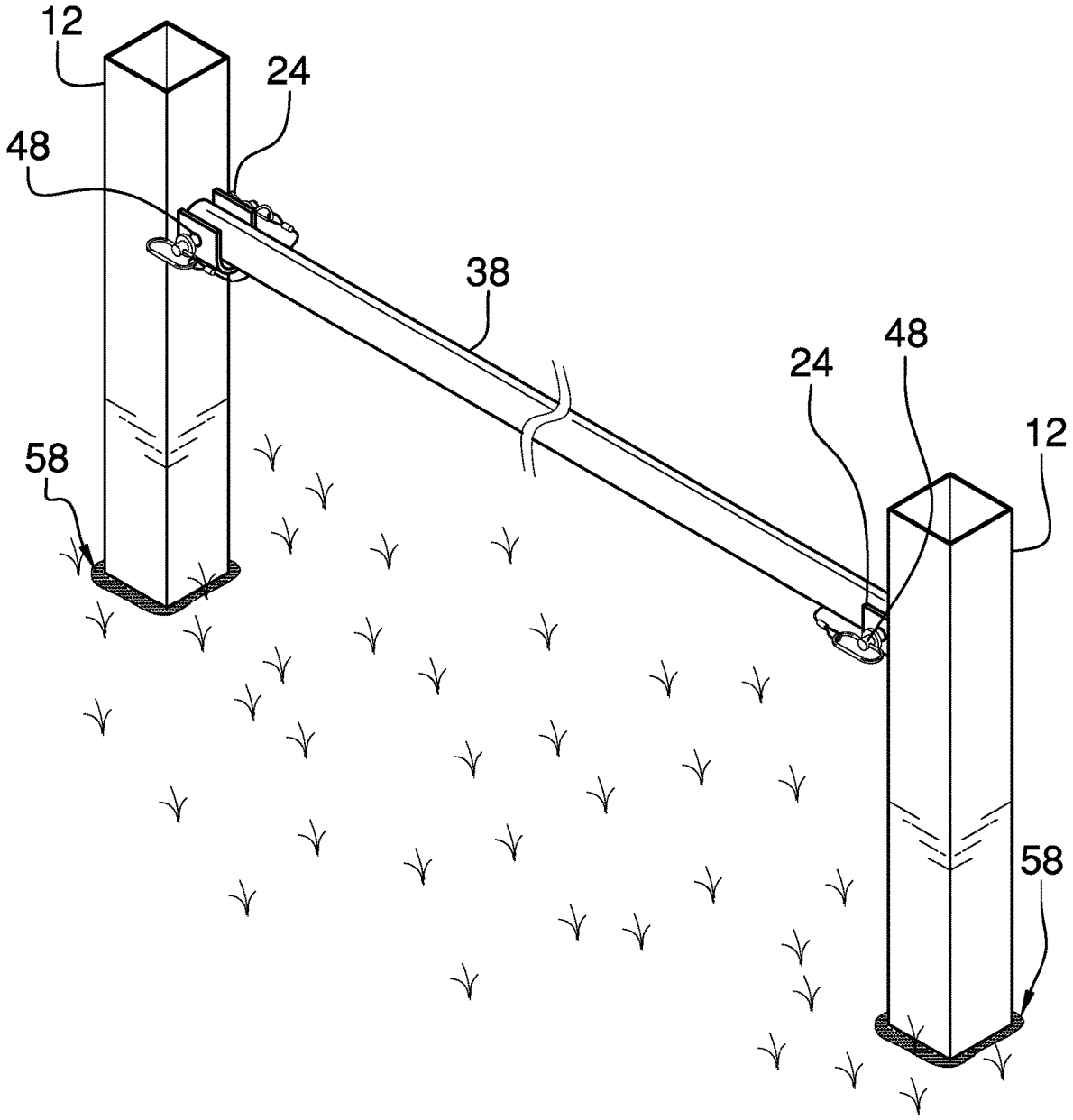
FIG. 2 is a perspective in-use view of an embodiment of the disclosure.
Figure 3:
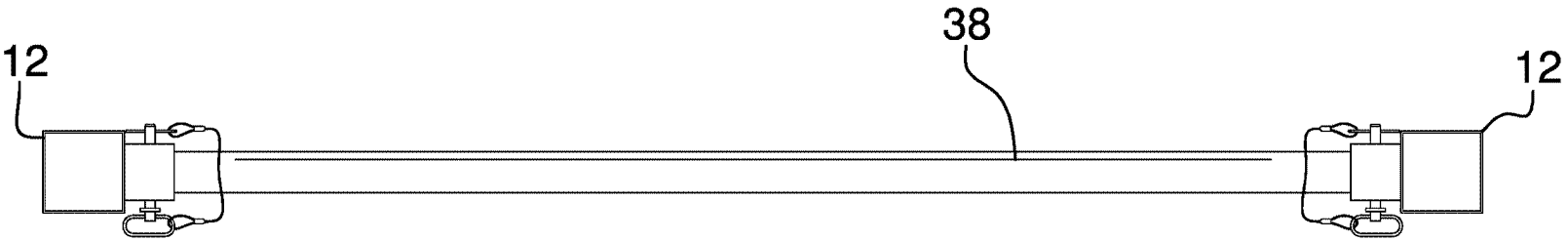
FIG. 3 is a bottom view of an embodiment of the disclosure.
Figure 4:
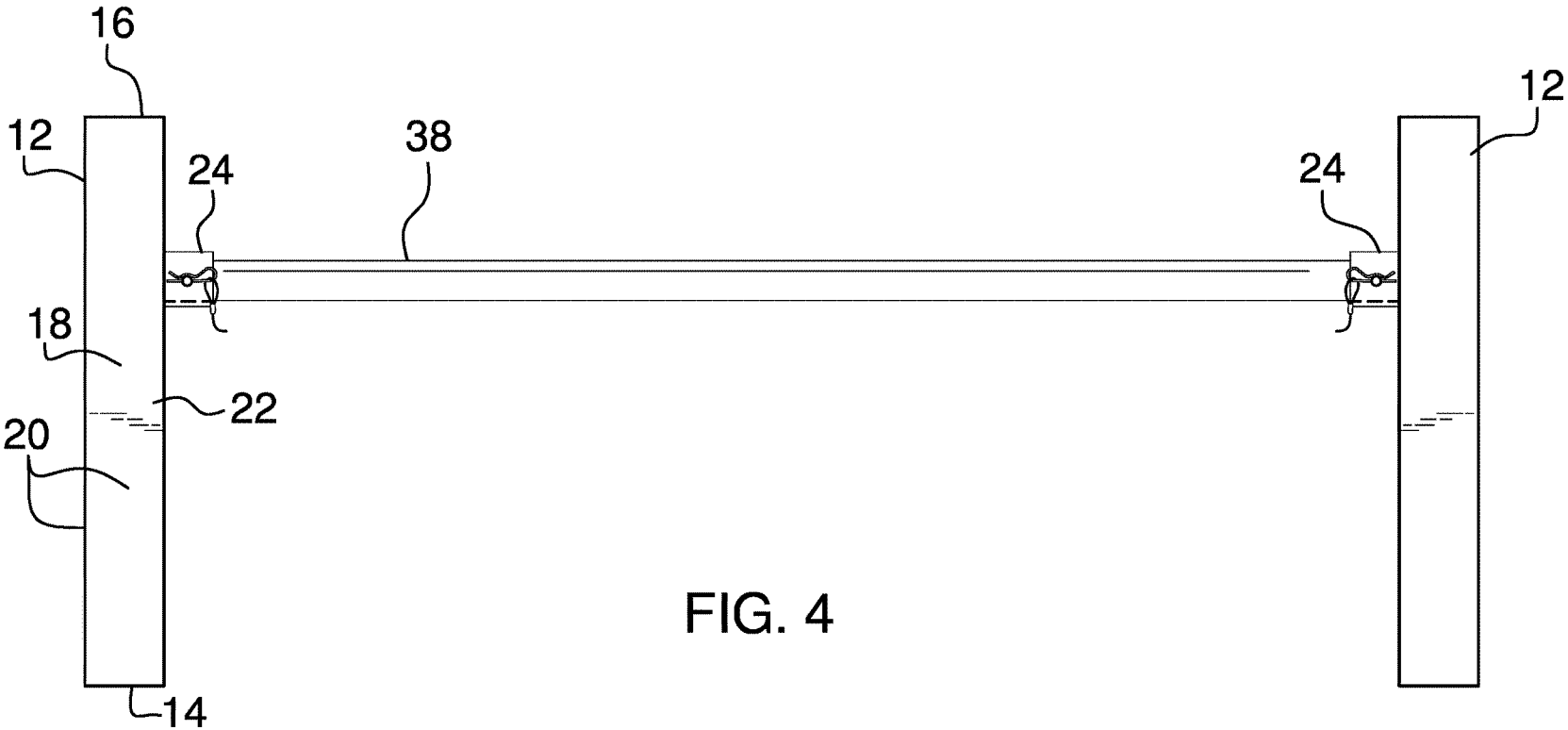
FIG. 4 is a front view of an embodiment of the disclosure.
Figure 5:
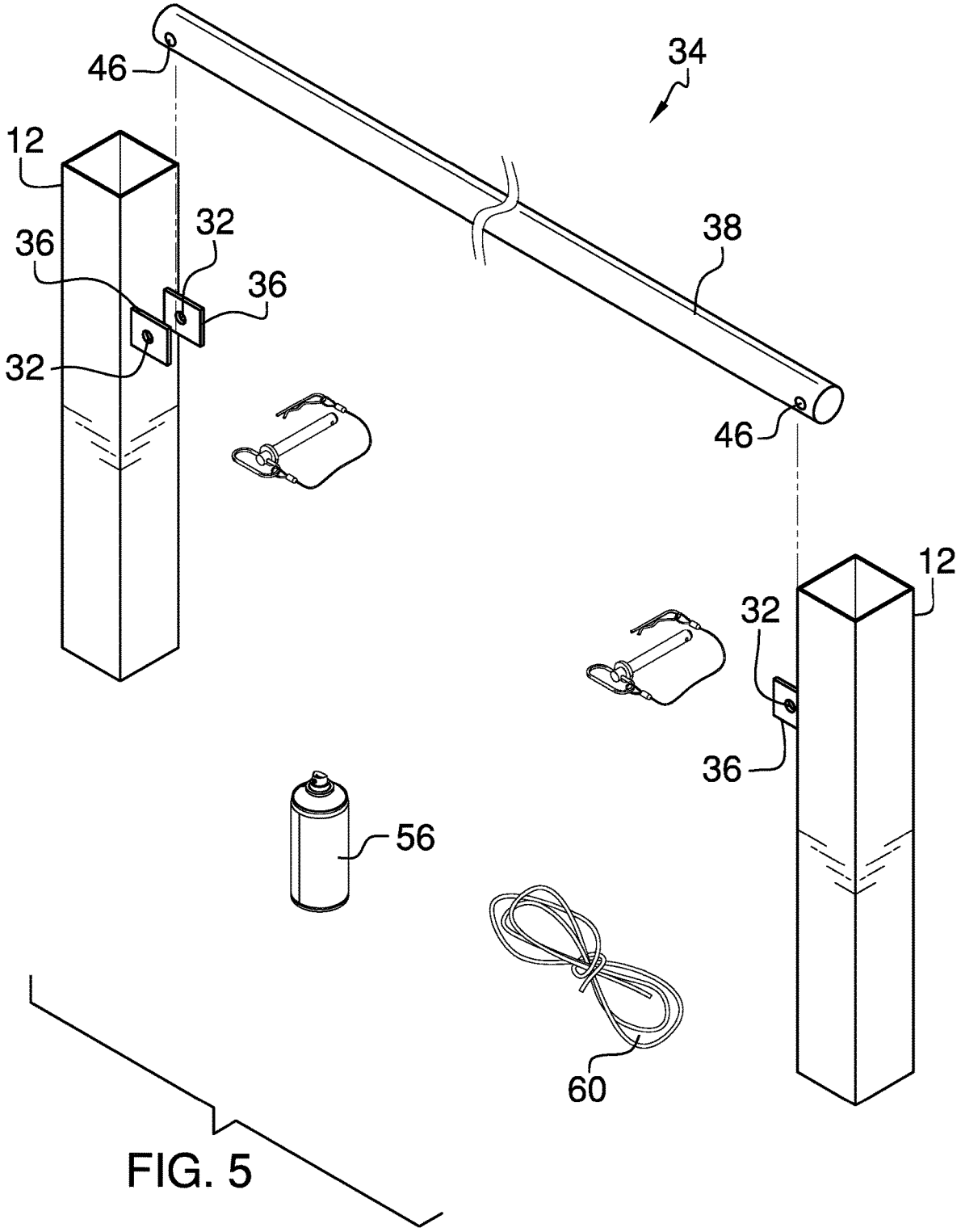
FIG. 5 is a perspective view of an alternative embodiment of the disclosure.
Figure 6:
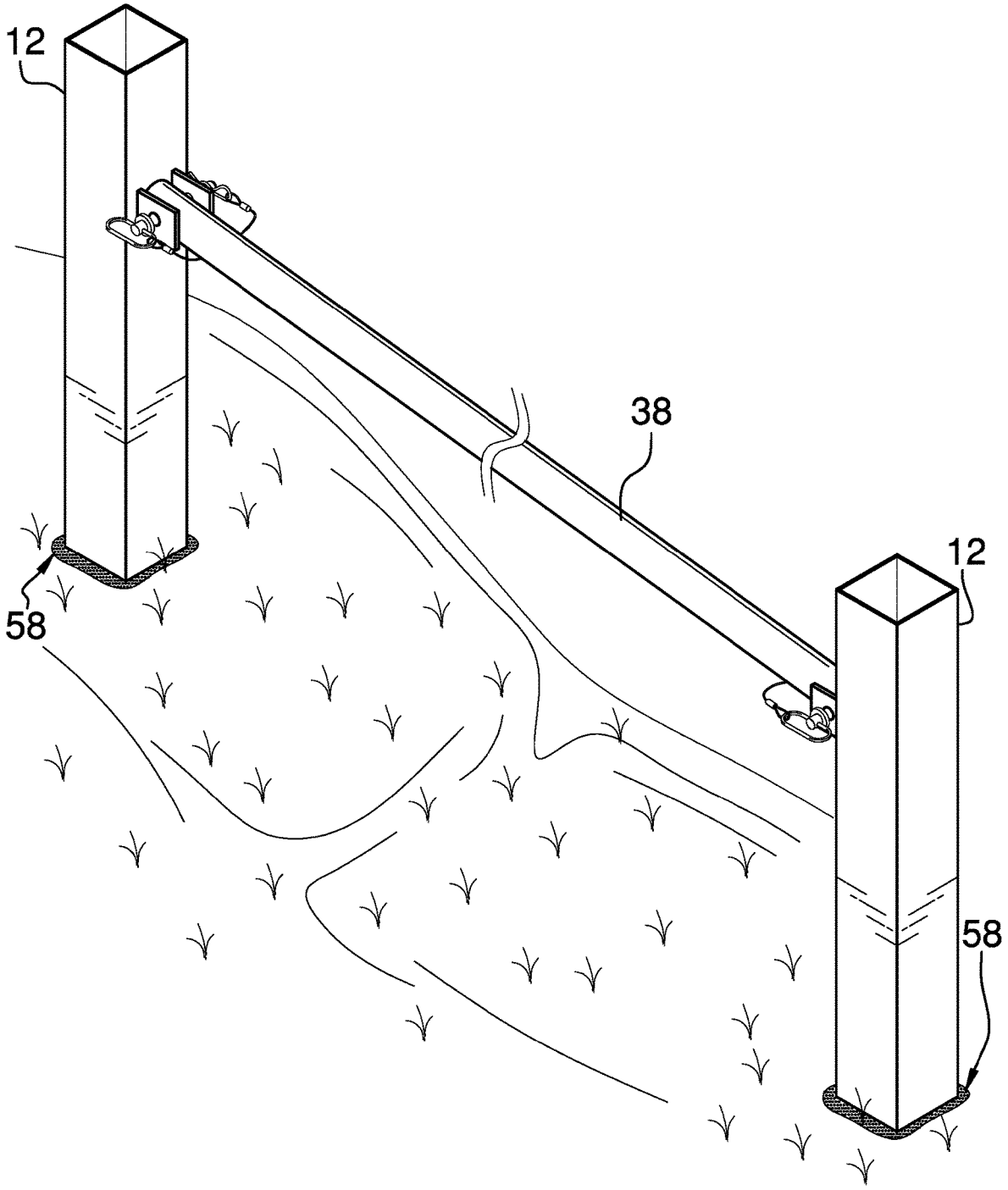
FIG. 6 is a perspective in-use view of an alternative embodiment of the disclosure.
Figure 7:
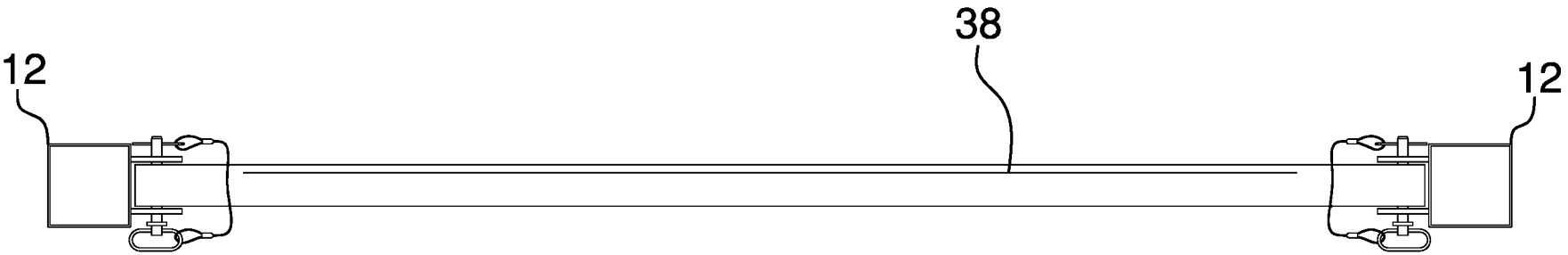
FIG. 7 is a bottom view of an alternative embodiment of the disclosure.
Figure 8:
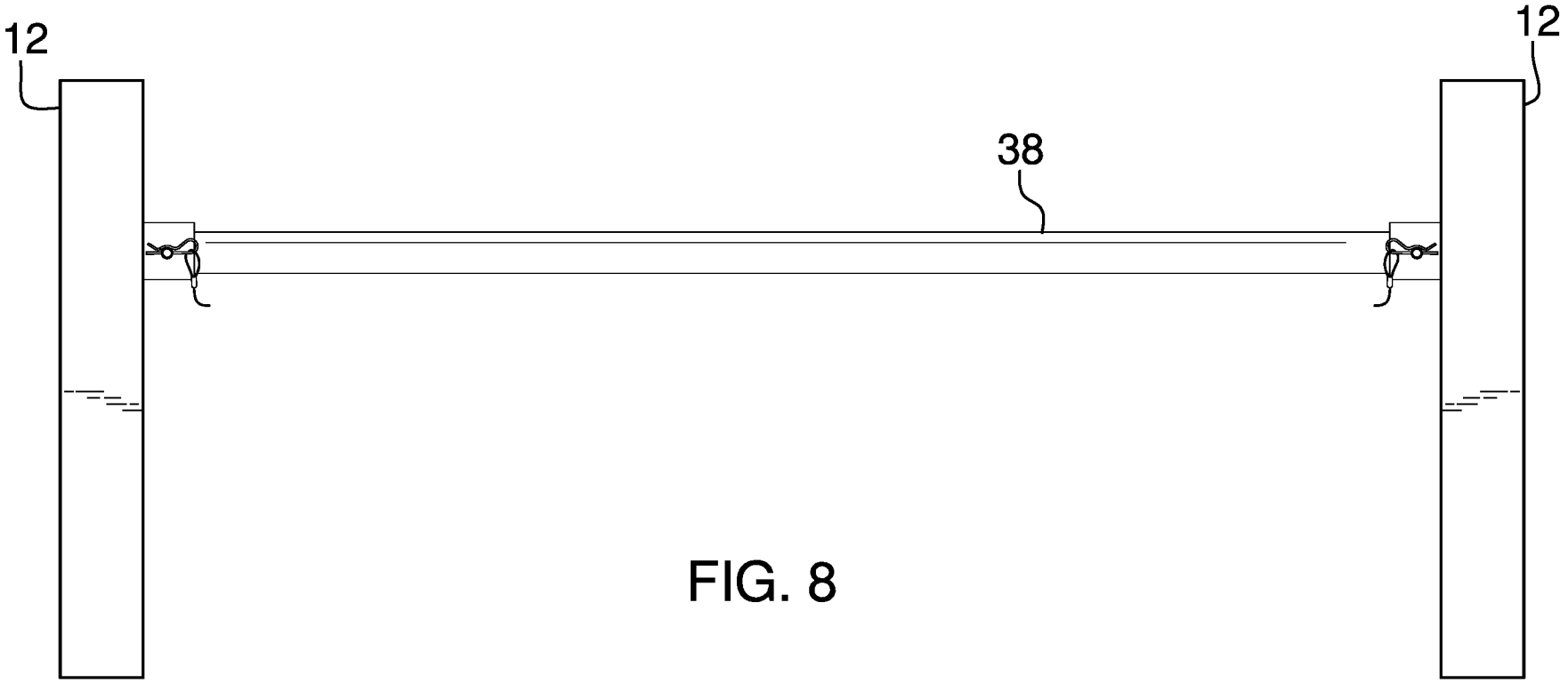
FIG. 8 is a front view of an alternative embodiment of the disclosure.

With reference now to the drawings, and in particular to FIGS. 1 through 8 thereof, a new marking device embodying the principles and concepts of an embodiment of the disclosure and generally designated by the reference numeral 10 will be described.

As best illustrated in FIGS. 1 through 8, the fence post marking assembly 10 generally comprises a pair of pipes 12 that is each positionable in an upright orientation on ground for marking the proposed location of a fence post. Each of the pipes 12 has a first end 14, a second end 16 and an outer wall 18 extending therebetween. The outer wall 18 of each of the pipes 12 has a plurality of intersecting sides 20 such that each of the pipes 12 has a rectangular shape, and the plurality of intersecting sides 20 includes a first side 22. Additionally, each of the intersecting sides 20 may have a width of at least 5.0 inches.

A pair of supports 24 is included and each of the supports 24 is coupled to a respective one of the pipes 12. Each of the supports 24 extends laterally away from the first side 22 of the outer wall 18 of the respective pipe 12. Each of the supports 24 is positioned closer to the first end 14 than the second end 16 of the respective pipe 12. Additionally, each of the supports 24 has a primary end 26, a secondary end 28 and an upper surface 30 extending therebetween. The upper surface 30 is concavely arcuate between the primary end 26 and the secondary end 28 having the primary end 26 being spaced from the secondary end 28 such that each of the supports 24 has a U-shape.

Each of the supports 24 has a pair of holes 32 extending therethrough and each of the holes 32 in respective supports 24 is spaced from a respective primary end 26 and secondary end 28 of the respective support 24. Additionally, the holes 32 in the respective support 24 are aligned with each other. In an alternative embodiment 34 as is shown in FIGS. 5 through 8, each of the supports 24 comprises a pair of plates 36 that are spaced apart from each other. Each of the plates 36 is oriented to extend along an axis extending through the first end 14 and the second end 16 of the respective pipe 12. Moreover, each of the pair holes 32 associated with each of the supports 24 extends through a respective one of the plates 36.

A rod 38 is positionable in each of the supports 24 thereby facilitating the pipes 12 to be spaced a pre-determined distance apart from each other. In this way the rod 38 can precisely space the proposed locations for fence posts apart from each other. The rod 38 has a first end 40, a second end 42 and an outside surface 44 extending therebetween. The rod 38 rests on the upper surface 30 of each of the supports 24 and the rod 38 has a pair of apertures 46 each extending through the outside surface 44. Each of the apertures 46 is positioned adjacent to a respective one of the first end 40 and the second end 42 of the rod 38. Additionally, each of the apertures 46 is aligned with the pair of holes 32 in a respective one of the supports 24 when the rod 38 is positioned in the supports 24. The rod 38 may have a length that corresponds to required spacing between fence posts on various, currently existing fences.

A pair of pins 48 is each extendable through a respective one of the supports 24 to engage the rod 38 for attaching the rod 38 to the supports 24. Each of the pins 48 is extendable through the pair of holes 32 in the respective support 24 and a respective one of the apertures 46 in the rod 38. Each of the pins 48 has a head 50 that has a diameter being greater than a diameter of the holes 32 in the respective support 24 to inhibit the pins 48 from passing fully through the holes 32.

Each of the pins 48 has a cable 52 that is attached to the head 50 and a retainer 54 that is coupled to the cable 52. The retainer 54 releasably engages the respective pin 48 when the respective pin 48 is extended through the respective support 24 and the rod 38. In this way the retainer 54 inhibits the respective pin 48 from being removed from the respective support 24 and the rod 38. The retainer 54 may comprise a cotter pin or other similar type of retainer.

A can of spray paint 56 is provided that is filled with a liquid paint 58 thereby facilitating the liquid paint 58 to be sprayed around each of the pipes 12 when the pipes 12 are positioned on the ground. In this way the spray paint 56 can mark the proposed location of the fence posts. The can of spray paint 56 may be an aerosolized spray can or the like and the liquid paint 58 may have a bright color for enhancing visibility of the liquid paint 58 when it is sprayed on the ground. A string 60 may be included for establishing a straight line on the ground that the proposed location of the fence posts will follow.

In use, the string 60 is laid out with best practices in order to establish a straight line on the ground that the proposed fence post locations will follow. The rod 38 is positioned in the support on each of the pipes 12 and the pins 48 are extended through the supports 24 to attach the rod 38 to the pipes 12. In this way the pipes 12 are spaced a predetermined distance apart from each other. Each of the pipes 12 is stood on the ground along the string 60 and the spray paint 56 is sprayed on the ground around each of the pipes 12. In this way a square marking is produced at precise locations for fence posts. The pair of pipes 12 is continually moved along the string 60 line until the entire length of the proposed fence line has been marked.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence post marking assembly for precisely marking the proposed locations of fence posts in a fence line, said assembly comprising:

a pair of pipes, each of said pipes being positionable in an upright orientation on ground wherein each of said pipes is configured to mark the proposed location of a fence post;

a pair of supports, each of said supports being coupled to a respective one of said pipes;

a rod being positionable in each of said supports thereby facilitating said pipes to be spaced a pre-determined distance apart from each other wherein said rod is configured to precisely space the proposed locations for fence posts apart from each other;

a can of spray paint being filled with a liquid paint thereby facilitating said liquid paint to be sprayed around each of said pipes when said pipes are positioned on the ground wherein said spray paint is configured to mark the proposed location of the fence posts; and wherein each of said supports has a primary end, a secondary end and an upper surface extending therebetween, said upper surface being concavely arcuate between said primary end and said secondary end having said primary end being spaced from said secondary end such that each of said supports has a U-shape.

2. The assembly according to claim 1, wherein each of said pipes has a first end, a second end and an outer wall extending therebetween, said outer wall of each of said pipes having a plurality of intersecting sides such that each of said pipes has a rectangular shape, said plurality of intersecting sides including a first side.

3. The assembly according to claim 2, wherein each of said supports extends laterally away from said first side of said outer wall of said respective pipe, each of said supports being positioned closer to said first end than said second end of said respective pipe.

4. The assembly according to claim 1, wherein each of said supports has a pair of holes extending therethrough, each of said holes in respective supports being spaced from a respective primary end and secondary end of said respective support such that said holes in said respective support are aligned with each other.

5. The assembly according to claim 4, wherein said rod has a first end, a second end and an outside surface extending therebetween, said rod resting on said upper surface of each of said supports, said rod having a pair of apertures each extending through said outside surface, each of said apertures being positioned adjacent to a respective one of said first end and said second end of said rod, each of said apertures being aligned with said pair of holes in a respective one of said supports when said rod is positioned in said supports.

6. The assembly according to claim 5, further comprising a pair of pins, each of said pins being extendable through a respective one of said supports and engaging said rod for attaching said rod to said supports, each of said pins being extendable through said pair of holes in said respective support and a respective one of said apertures in said rod, each of said pins having a head having a diameter being greater than a diameter of said holes in said respective support thereby inhibiting said pins from passing fully through said holes.

7. The assembly according to claim 6, wherein each of said pins has a cable being attached to said head and a retainer being coupled to said cable, said retainer releasably engaging said a respective pin when said respective pin is extended through said respective support and said rod for inhibiting said respective pin from being removed from said respective support and said rod.

8. A fence post marking assembly for precisely marking the proposed locations of fence posts in a fence line, said assembly comprising:

a pair of pipes, each of said pipes being positionable in an upright orientation on ground wherein each of said pipes is configured to mark the proposed location of a fence post, each of said pipes having a first end, a second end and an outer wall extending therebetween, said outer wall of each of said pipes having a plurality of intersecting sides such that each of said pipes has a rectangular shape, said plurality of intersecting sides including a first side;

a pair of supports, each of said supports being coupled to a respective one of said pipes, each of said supports extending laterally away from said first side of said outer wall of said respective pipe, each of said supports being positioned closer to said first end than said second end of said respective pipe, each of said supports having a primary end, a secondary end and an upper surface extending therebetween, said upper surface being concavely arcuate between said primary end and said secondary end having said primary end being spaced from said secondary end such that each of said supports has a U-shape, each of said supports having a pair of holes extending therethrough, each of said holes in respective supports being spaced from a respective primary end and secondary end of said respective support such that said holes in said respective support are aligned with each other;

a rod being positionable in each of said supports thereby facilitating said pipes to be spaced a pre-determined distance apart from each other wherein said rod is configured to precisely space the proposed locations for fence posts apart from each other, said rod having a first end, a second end and an outside surface extending therebetween, said rod resting on said upper surface of each of said supports, said rod having a pair of apertures each extending through said outside surface, each of said apertures being positioned adjacent to a respective one of said first end and said second end of said rod, each of said apertures being aligned with said pair of holes in a respective one of said supports when said rod is positioned in said supports;

a pair of pins, each of said pins being extendable through a respective one of said supports and engaging said rod for attaching said rod to said supports, each of said pins being extendable through said pair of holes in said respective support and a respective one of said apertures in said rod, each of said pins having a head having a diameter being greater than a diameter of said holes in said respective support thereby inhibiting said pins from passing fully through said holes, each of said pins having a cable being attached to said head and a retainer being coupled to said cable, said retainer releasably engaging said a respective pin when said respective pin is extended through said respective support and said rod for inhibiting said respective pin from being removed from said respective support and said rod; and a can of spray paint being filled with a liquid paint thereby facilitating said liquid paint to be sprayed around each of said pipes when said pipes are positioned on the ground wherein said spray paint is configured to mark the proposed location of the fence posts.

9. The assembly according to claim 8, wherein each of said supports comprises a pair of plates being spaced apart from each other, each of said plates being oriented to extend along an axis extending through said first end and said second end of said respective pipe, each of said pair holes associated with each of said supports extending through a respective one of said plates.

* * * * *